United States Patent [19]

Stottmann

[11] 4,233,819

[45] Nov. 18, 1980

[54] AUTOMATIC ICEMAKER WITH SIMPLIFIED ICE PIECE EJECTION

[75] Inventor: Richard L. Stottmann, Louisville, Ky.

[73] Assignee: General Electric Company, Louisville, Ky.

[21] Appl. No.: 35,380

[22] Filed: May 3, 1979

[51] Int. Cl.[3] ..... F25C 1/10

[52] U.S. Cl. ..... 62/349; 62/340; 165/105

[58] Field of Search ..... 62/72, 71, 353, 340, 62/349; 165/105

[56] References Cited

U.S. PATENT DOCUMENTS

| | | | |
|---|---|---|---|
| 2,341,700 | 2/1944 | Diack et al. . | |
| 2,407,058 | 9/1946 | Clum | 62/353 X |
| 2,941,377 | 6/1960 | Nelson | 62/73 |
| 3,618,335 | 11/1971 | Toma | 62/349 |
| 3,736,767 | 6/1973 | Lukes | 62/349 |
| 3,914,957 | 10/1975 | Jacobs | 165/105 X |
| 4,003,214 | 1/1977 | Schumaker | 62/340 |

*Primary Examiner*—Albert J. Makay
*Assistant Examiner*—William E. Tapolcai, Jr.
*Attorney, Agent, or Firm*—Frederick P. Weidner; Radford M. Reams

[57] ABSTRACT

An icemaker with simplified ice ejection. A hollow rotatable mold is provided with parallel rows of ice cups mutually inverted on opposing sides of the mold axis of rotation. A volatile liquid at low pressure within the mold is volatilized by heat energy of incoming fresh water in the upward facing cups. The heated vapor communicates with the inverted cups to cause expansion of the cups and contraction of the ice pieces resulting in a shear action which ejects the ice pieces with the aid of gravity into a storage receptacle. After ejection, the exposed surface of the empty ice cups accelerates formation of new ice pieces in the upward facing cups via the boiling-condensing cycle of the volatile liquid.

5 Claims, 3 Drawing Figures

AUTOMATIC ICEMAKER WITH SIMPLIFIED ICE PIECE EJECTION

BACKGROUND OF THE INVENTION

The present invention is directed to an automatic icemaker of the type utilizing the energy of the fresh water supply to eject ice pieces from the mold cups of the icemaker.

Automatic icemakers are popular accessories for household refrigerators and numerous attempts have been made to simplify the design of the icemaker so as to reduce its cost. One of the problems associated with the design of automatic icemakers relates to the removal of the frozen ice pieces from the mold cups after they have been formed. U.S. Pat. No. 3,736,767 issued June 5, 1973 and assigned to the assignee of the present invention discloses a reversible mold employing a flexible bottom wall as the ice forming cup. After an ice piece has been formed in the mold cup, the mold is rotated 180° and a fresh supply of water is entered into the empty, upward-facing receptacle. As the heat of the water warms the flexible wall the ice piece below is released and the flexible wall drops down to form a new cup for formation of a new ice piece. Although a useful concept, it nevertheless relies on the continued flexibility of the flexible bottom wall and as such presents a potential long term product service problem.

U.S. Pat. No. 2,941,377 issued June 21, 1960 is an example of the use of a contained charge of a volatile fluid, such as freon, in the mold. When heated by auxiliary means, the fluid vaporizes and causes a deformation of the ice forming cup to eject the ice piece. The structure disclosed is relatively complex and relies on the changing shape of the ice cup as the mechanism for ejection of the ice piece. It also has the objection of being quite noisy as the ejected ice pieces ricochet off an overhead deflector into the storage receptacle.

There is a need, therefore, for a simplified form of automatic icemaker with an inexpensive low cost form of ice ejection that is of long term reliability.

SUMMARY OF INVENTION

In accordance with the present invention, there is provided an automatic icemaker comprising a rotatable ice mold having a plurality of ice forming cups inverted with respect to each other on opposite sides of the mold axis of rotation. Each of the cups has a concave wall in which ice pieces are formed and a back wall spaced from the concave wall and joined thereto so as to form an enclosed cavity between the walls. The cavities of cups adjoining on opposite sides of the mold axis of rotation are in fluid communication with each other. The icemaker also includes a volatile liquid disposed within the cup cavity so as to be in thermal contact with a substantial portion of the cup's concave wall when the cup is in its ice forming position. Means are further provided for rotating the mold between alternate ice forming positions in which the cavity of an upwardly-facing cup is lower than the cavity of the adjoining downwardly-facing cup with which it is in fluid communication. Finally, the icemaker includes means for supplying a controlled amount of fresh water to the upwardly-facing cup when in its ice forming position whereby heat from the fresh water volatilizes the liquid within the cavity causing heated vapor to rise to the cavity of the higher cup where it condenses and transfers heat to the concave wall of the higher cup to release an ice piece held therein, the condensate thereupon returning to the lower cavity in which a new ice piece is being formed.

DETAILED DESCRIPTION

Figure 1:
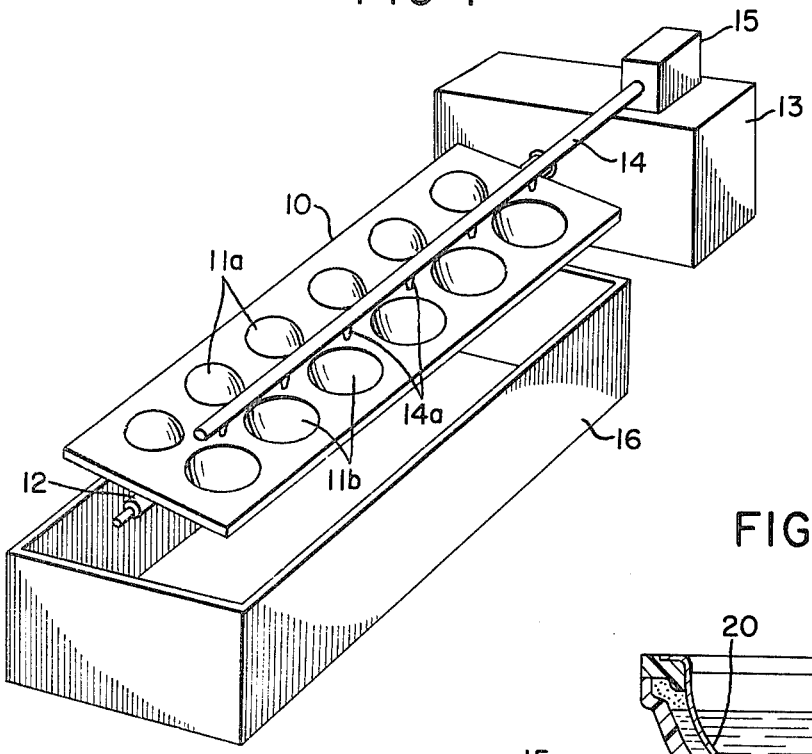
FIG. 1 is a perspective schematic illustration of an ice-maker constructed in accordance with the present invention.

Referring to the automatic icemaker of FIG. 1, a rotatable ice mold 10 is shown as having parallel rows of ice forming cups 11*a* and 11*b* on opposite sides of the mold's axis of rotation 25 with cups 11*a* being inerted with respect to cups 11*b*. The mold is attached to a rotating arm 12 which is actuated by a motor drive 13 for rotating the mold to alternate each row of cups into a slightly canted ice forming position illustrated by cup 11*b* in FIG. 2. A perforated water supply tube 14 extends outwardly from a control valve 15 to supply a controlled amount of fresh water through ports 14*a* to each of the upwardly facing cups 11*b* when they are in their ice forming position. A storage receptacle 16 serves to hold the ice pieces after ejection from the mold. When receptacle 16 is full, suitable means (not shown) are provided to discontinue further operation of the icemaker until there is room in the receptacle to receive additional ice pieces. It will be appreciated that the controls necessary to rotate mold 10 and inject the appropriate charge of fresh water into the ice forming cups are well known and no further description thereof is necessary for an understanding of the principles of the present invention.

Figure 3:
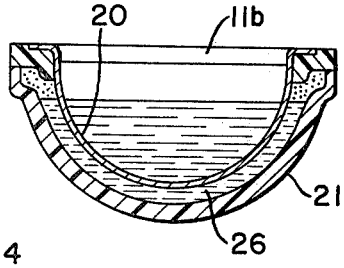
FIGS. 2 and 3 are sectional views of the mold ice cups of FIG. 1 illustrating structural details of the present invention.
Figure 2:
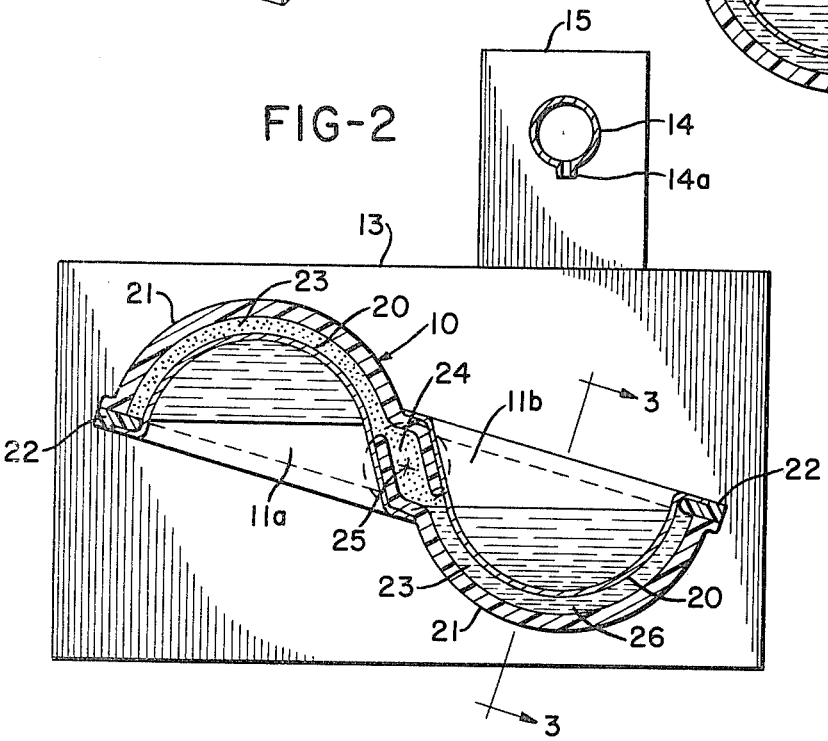

Referring now specifically to FIGS. 2 and 3, each of the cups 11*a* and 11*b* include a concave wall 20 which may be formed of metal material, such as copper or aluminum, having a high thermal conductivity. While any of a variety of cup shapes may be employed, the preferred shape illustrated is that of generally a hemisphere. The mold cups 11*a*, 11*b* further include a back wall 21 spaced away from the concave wall 20 and joined to wall 20 at junction 22 generally around the periphery of wall 20 so as to form an enclosed cavity space between walls 20 and 21. In accordance with one aspect of the invention, the cavities of adjoining cups 11*a* and 11*b* on opposite sides of the mold axis of rotation are in fluid communication with each other through passage 24 extending, for example, through the mold axis of rotation 25. Cups 11*a* and 11*b* lie generally in a common plane extending through the mold axis of rotation. When mold 10 has been rotated to a stationary ice forming position, it is in a slightly canted attitude with upwardly facing cups 11*b*, in which new ice pieces are to be formed, being lower than downwardly facing cups 11*a*, in which previously formed ice pieces are held prior to their release into receptacle 16.

A volatile liquid 26, such as R-11, is disposed within cavity space 23 at a low pressure of about 2.7 psia at the temperature within the freezer of about 2° F. The liquid, which at this low pressure volatilizes above 2° F., may be inserted at room ambient pressure and temperature by evacuating the cavity space and then allowing the desired amount of liquid to be sucked into the cavity space after which the cavity is sealed. With mold 10 in its canted ice forming attitude, there should be sufficient amount of volatile liquid in the lower cavity space 23 to be in thermal contact with a substantial portion and preferably all of the lower concave wall 20 so as to embrace the same portion of concave wall 20 as is covered by the fresh water supply.

In the operation of the invention, and assuming an ice piece has previously been formed in cups 11*a*, mold 10 is rotated into an ice forming position as illustrated in FIG. 2. A charge of fresh water is supplied by supply tube 14 through the individual apertures 14*a* into the upwardly facing cups 11*b*. The heat energy contained within the fresh water is transferred through the thin metal wall 20 to the volatile liquid 26. This liquid quickly volatilizes by absorbing the water energy thus turning into a vapor which travels up through passage 24 into the cavity space 23 behind concave wall 20 of the higher cups 11*a*. When the vapor reaches this upper cavity, it reacts to the cold surface of the metal wall 20 and condenses into a liquid thus giving up the heat energy to the metal cups 11*a*. The condensed liquid then drains down back through passage 24 to replenish the liquid 26 surrounding the wall 20 of the lower cups 11*b*. Thus the heat energy of the supply water is transferred to the higher cups by a boiling-condensing cycle with gravity draining the condensate back to the cavities of the lower cups.

As this heat energy is transferred, the upper concave wall 20 temperature rises and the wall begins to expand due to this temperature increase. At the same time, the ice pieces held within cups 11*a* begin to absorb energy via transfer through the metal wall 20 and begins to contract slightly. After sufficient energy is transferred to the concave wall 20, the ice pieces therein separate due to the strain of expansion and contraction at their interface thus causing the ice piece to fall into the receptacle 16. It will be appreciated that while expansion and contraction is involved in this ice piece ejection mechanism, there is only minor physical movement of the concave wall 20 during the ejection process.

To assist in assuring that a sufficient supply of energy is delivered to the upper cup and not wasted, the back walls 21 of both cups 11*a* and 11*b* are preferably made from a low thermal conductive material such as nylon or other plastic material impervious to the volatile liquid. To further reduce this heat loss, the interior surfaces of back walls 21 may be coated with an insulating material prior to their assembly into the mold 10 construction.

After the ice piece has been ejected from the upper cups 11*a*, concave wall 20 becomes a heat exchange surface with the freezer air and the boiling-condensing cycle continues until the water in the lower cups 11*b* is frozen and the entire system then stabilizes with its ambient environment.

There has been described an automatic icemaker having a simplified ice ejection mechanism utilizing a minimum of moving parts. Although, in accordance with the patent statutes, there has been described what at present is considered to be the preferred embodiment of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. An icemaker comprising:

a rotatable ice mold having a plurality of ice forming cups inverted and offset with respect to each other on opposite sides of the mold's axis of rotation, each of the cups having a concave wall in which ice pieces are formed and a back wall spaced from said concave wall and joined thereto so as to form an enclosed cavity between the walls, the cavities of cups adjoining on opposite sides of said axis of rotation being in fluid communication with each other;

a volatile liquid disposed in said cup cavity so as to be in thermal contact with a substantial portion of the cup's concave wall when the cup is in its ice forming position;

means for rotating the mold between alternate ice forming positions in which the cavity of an upwardly facing cup is lower than the cavity of the adjoining downwardly facing cup with which it is in fluid communication; and means for supplying a controlled amount of fresh water to the upwardly facing cup when in its ice forming position, whereby heat from the fresh water volatilizes said liquid causing heated vapor to rise to the cavity of the higher cup where it condenses and transfers heat to the concave wall of the higher cup to release an ice piece held therein, the condensate thereupon returning to the lower cavity in which a new ice piece is being formed.

2. The icemaker of claim 1 in which the liquid in said cavity is at a pressure of approximately 2.7 psia at 2° F. and, at this pressure, volatilizes at temperatures about 2° F.

3. The icemaker of claim 1 in which the concave wall is comprised of a material having a high thermal conductivity and the material of the back wall is of a material having a low thermal conductivity.

4. The icemaker of claim 1 in which the said adjoining cups lie generally in the same plane passing through the mold axis of rotation and said plane is canted from the horizontal when the mold is in its ice forming position.

5. The icemaker of claim 1 in which said cup concave wall is generally in the shape of a hemisphere and said back wall is of a mating, generally hemispherical shape.

* * * * *